US005934585A

United States Patent [19]

Chaney

[11] Patent Number: 5,934,585

[45] Date of Patent: Aug. 10, 1999

[54] REFINER PLATE ASSEMBLY AND METHOD OF MOUNTING

[76] Inventor: Michael B. Chaney, 1005 Garvens Ave., Brookfield, Wis. 53005

[21] Appl. No.: 08/841,816

[22] Filed: May 5, 1997

[51] Int. Cl.[6] ..... B02C 7/02

[52] U.S. Cl. ..... 241/298; 241/261.2

[58] Field of Search ..... 241/298, 297, 241/261.2, 261.3

[56] References Cited

U.S. PATENT DOCUMENTS

| | | | |
|---|---|---|---|
| 2,425,024 | 8/1947 | Beveridge et al. | 92/6 |
| 3,240,437 | 3/1966 | Horstmann | 241/298 |
| 3,289,954 | 12/1966 | Jones | 241/298 |
| 3,326,480 | 6/1967 | Jones | 241/298 |
| 3,452,939 | 7/1969 | Johnson | 241/260 |
| 4,005,827 | 2/1977 | Frair et al. | 241/261.3 |
| 4,036,443 | 7/1977 | Saltarelli | 241/297 |
| 4,081,147 | 3/1978 | Seifert et al. | 241/261.3 |
| 4,610,400 | 9/1986 | Sjöbom | 241/261.2 |
| 4,681,270 | 7/1987 | Oberhofer | 241/298 |
| 4,783,014 | 11/1988 | Fredriksson et al. | 241/261.2 |
| 5,449,122 | 9/1995 | Berger et al. | 241/261.2 |

FOREIGN PATENT DOCUMENTS

| | | |
|---|---|---|
| 0 791 395 A1 | 4/1996 | European Pat. Off. . |
| 1806612 | 11/1968 | Germany . |
| 2 157 974 | 10/1984 | United Kingdom . |

OTHER PUBLICATIONS

PCT Publ. No. WO 87/06963 published Nov. 19, 1987.
English Abstract of German Offenlegungschrift 1806612.
Beloit Jones Multi–Disk Refiners, Beloit Fiber Systems Division.
Beloit Jones DD® 4000 Refiners, Fiber Systems Division, Beloit Corporation.

*Primary Examiner*—Joseph J. Hail, III
*Assistant Examiner*—William Hong
*Attorney, Agent, or Firm*—Nilles & Nilles S.C.

[57] ABSTRACT

A universal refiner plate assembly and a method of mounting the same within a disk refiner, such as a double disk refiner, a multiple disk refiner, or a counter-rotating disk refiner is described. When refiner plates of different manufacturers are of similar diameters, a universal plate mounting mechanism is possible. One refiner plate will fit in all types of refiners made by various manufacturers. A customized subplate will mount into a disk refiner directly to a rotor or stator as needed. A universal refiner plate will attach to the subplate. As a result, a refiner plate manufacturer will be able to make one refiner plate pattern to be used in various disk refiners of the same diameter. A refiner plate with finer bars and grooves is possible because the size of a refiner plate is reduced. The universal refiner plate and the customized subplate will eliminate the single one-piece fabricated plate currently used in multiple disk refiners. Thus, multiple disk refiners will now be able to recognize the benefits obtained by using segmented refiner plates.

35 Claims, 8 Drawing Sheets

REFINER PLATE ASSEMBLY AND METHOD OF MOUNTING

BACKGROUND OF THE INVENTION

1. Field of the Invention

The present invention relates to disk refiners and more particularly to improvements in refiner plates and mounting assemblies therefor.

2. Description of the Prior Art

Disk refiners are used in the paper manufacturing industry to prepare the cellulose fibers of a paper pulp into a desired condition prior to delivering the pulp to the papermaking machine. One such refiner is commonly referred to as a double disk refiner, as described in U.S. Pat. No. 4,083,503. In this type of refiner, two refiner plates are attached to opposite sides of a rotating disk, or rotor, and complementary refiner plates are attached to nonrotating elements, or stators. Another type of disk refiner is commonly referred to as a multiple disk refiner as described in U.S. Pat. No. 4,783,014. In this type of refiner, a plurality of rotatable and nonrotatable refiner plates are interleaved within a refining chamber of the refiner. Still another type of refiner is a refiner of the two disk type, commonly referred to as a counter or contra-rotating disk refiner, as described in U.S. Pat. No. 4,129,263. In this type of refiner, two counter-rotating refining disks are located each on a shaft which are driven individually by motors.

The refiner plates in double disk refiners, multiple disk refiners, and counter-rotating disk refiners have a working refining surface usually involving a plurality of raised, rib-like projections, generally called bars. In operation, these bars and other portions of the working surface are gradually abraded or worn away, so that it is periodically necessary to shut down a disk refiner and replace the refiner plates used therein.

There are many different types of refiner plates and refiner plate patterns which are well-known within the paper industry. One type of a refiner plate is a complete annular plate which is cast as a one-piece member. A major disadvantage of this complete annular plate is the high cost associated with fabricating such a plate. Moreover, if only a small section of the plate is worn or damaged, because the replacement plate is a single piece, the entire refiner plate would have to be replaced.

An improvement over the one-piece refiner plate is a refiner plate which comprises a plurality of individual segments which cooperatively form an annular plate when fitted together. The advantages of these segmented plates is the ease of handling, the ease of replacing worn or damaged segments, and they are much less expensive to manufacture than the complete one-piece annular disk.

Just as there are many different types of refiner plates, there are also many different manufacturers that produce these various refiner plates. Additionally, disk refiners come in a variety of different diameters. Typically, disk refiners are of a size to use refiner plates which generally range in diameter from 20 inches to 42 inches. The manner of mounting the refiner plates in the refiner varies from manufacturer to manufacturer. Even a single refiner manufacturer may supply different types of refiners with different plate mounting arrangements. The number, size, and spacing of mounting bolts used varies significantly from manufacturer to manufacturer, and from one size of refiner to another. As a result, because each refiner manufactured by different manufacturers has its own particular mounting pattern to be used in conjunction with that manufacturer's refiner plates, a refiner plate manufacturer supplying refiner plates for several manufacturer's refiners must supply numerous different refiner plates of the same diameter to be used in the many different disk refiners, even if the same bar configuration is used.

Refiner plates like those shown in U.S. Pat. Nos. 4,039,154 and 5,425,508 are typically used in double disk refiners and counter-rotating refiners. These plates are normally cast as a plurality of individual segments which are machined to obtain the desired shape and contours. The segments are assembled to form a complete annular plate. Other refiner plates for other refiners, e.g., multiple disk refiners, and particularly, refiners of smaller diameter, may be fabricated as one-piece plates.

In treating some pulps, low intensity treatment is desirable. It is widely known that low-intensity treatment of certain pulp fiber increases the strength characteristics of the pulp while reducing the amount of specific energy required during refining. As disclosed in U.S. Pat. No. 4,661,911, a reduction in intensity may be accomplished in a refiner having an increased number of refining surfaces. Thus, the multiple disk refiner was a new and improved disk refiner for low intensity treatment of pulp fiber. Still, however, an increase in the number of refining surfaces can further be accomplished by producing a refiner plate with finer bars and grooves than that possible using heretofore accepted processes and designs.

SUMMARY OF THE INVENTION

The problem of manufacturing many different refiner plate configurations of a given diameter to accommodate each disk refiner manufacturer's own specific mounting patterns for its refiner plates has been solved by creating a universal refiner plate that fits in all or most new and existing disk refiners of the same diameter, which attaches to a customized reusable subplate mounted directly to a rotor or stator as necessary. In this way, a refiner plate manufacturer is able to make one refiner plate pattern to be used in various disk refiners of the same diameter, instead of having to manufacture a different refiner plate for each different disk refiner. Further, the problem of using a fabricated one-piece plate in certain refiners has also been solved by creating universal refiner plate segments, which are then fixedly attached to a customized subplate according to the present invention.

In order to produce a refiner plate with finer bars and grooves, the overall cast size of a refiner plate segment used in conjunction with other refiner plate segments to form a complete refiner plate must be reduced. Using a customized subplate to which refiner plate segments are mounted, allows refiner plate manufacturers to cast smaller refiner plate segments that could not be created with existing bolt hole patterns. The refiner plate segments shown as one piece segments in U.S. Pat. Nos. 4,039,154 and 5,425,508 are now frequently provided as two pieces or as many pieces as feasible, and when fitted together with other refiner plate segments, the segments form a complete annular refiner plate. Reducing the size of refiner plates allows the refiner plate manufacturer to utilize a casting procedure known in the art as investment casting, rather than the currently used sand casting method. Investment casting is much more accurate than sand casting and, as a result, the refiner plate manufacturer is able to create refiner plate segments with finer bars and grooves. Having finer bars and grooves increases the number of refining surfaces which reduces the intensity treatment of pulp and increases the strength characteristics of the pulp.

Accordingly, it is a feature of the present invention to provide a new and improved refiner plate for low intensity treatment of pulp fiber.

Another feature of the invention is the separation of the refining surface from the mounting portion of the refiner plate, thus allowing standardization of the refining surface portion of the plate and reuse of the mounting portion.

A further feature of the invention is to manufacture a refiner plate which has finer bar patterns and grooves, allowing the use of different casting techniques such as investment casting.

An additional feature of the invention is to provide a single refiner plate that can be used in various disk refiners of the same diameter.

Still another feature of the invention is to reduce the cost associated with manufacturing and storing many different refiner plates for the same size diameter of disk refiners.

These and other objects, features, and advantages of the invention will become readily apparent to those skilled in the art upon reading the description of the preferred embodiments, in conjunction with the attached drawings.

DESCRIPTION OF THE PREFERRED EMBODIMENTS

Figure 1:
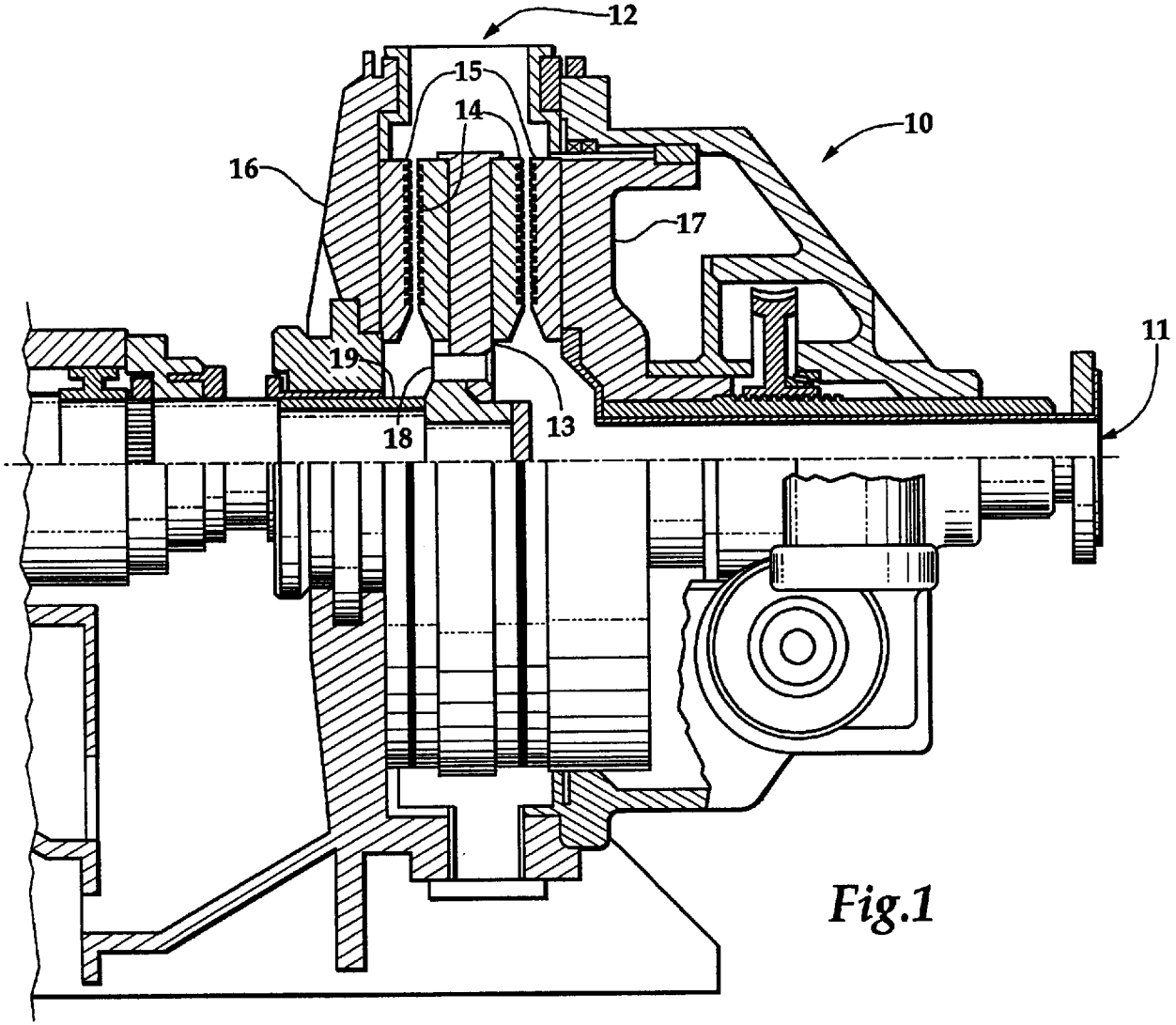
FIG. 1 is an elevational view of a double disk refiner in partial cross-section.
Figure 2:
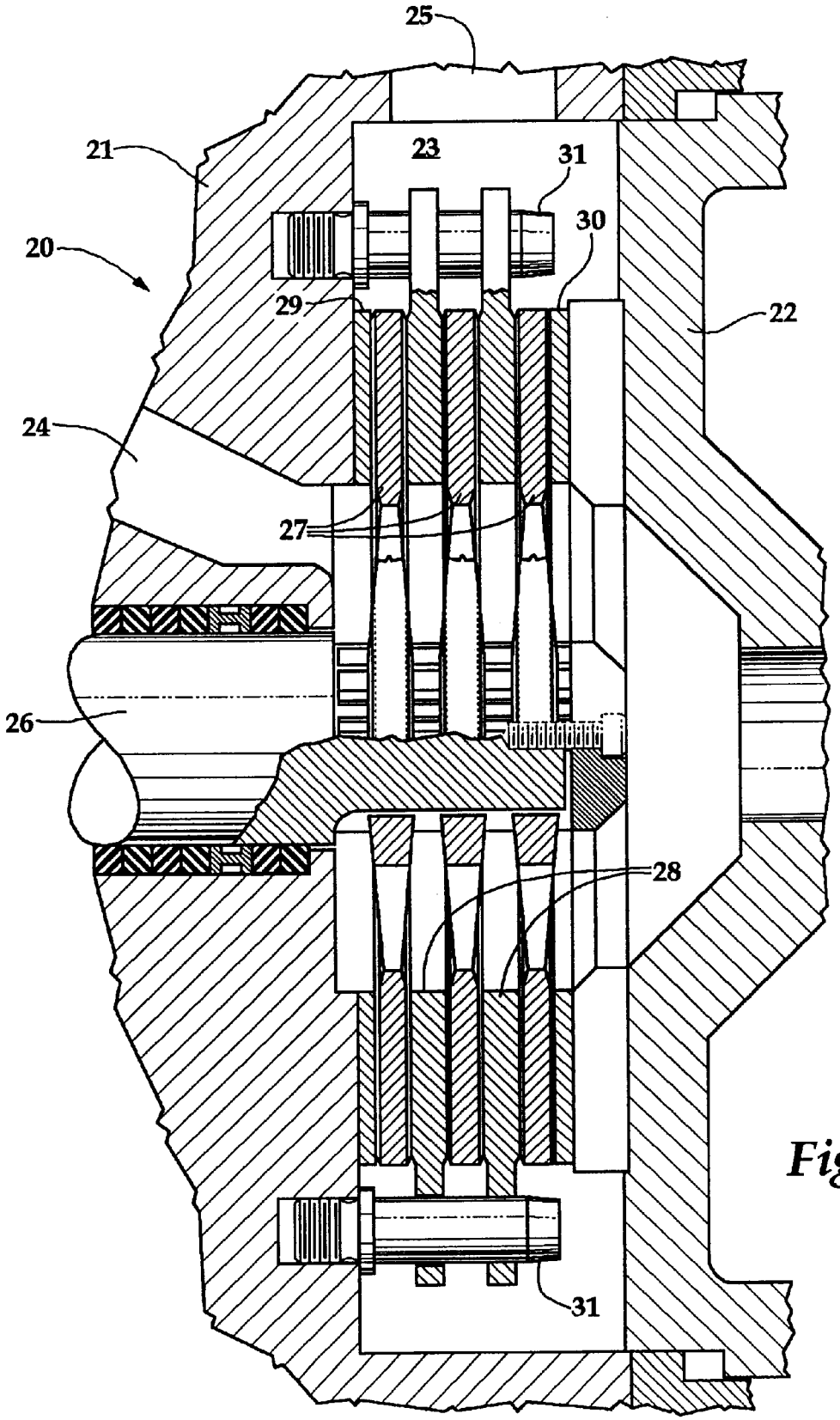
FIG. 2 is a fragmentary, cross-sectional view of a multiple disk refiner.
Figure 3:
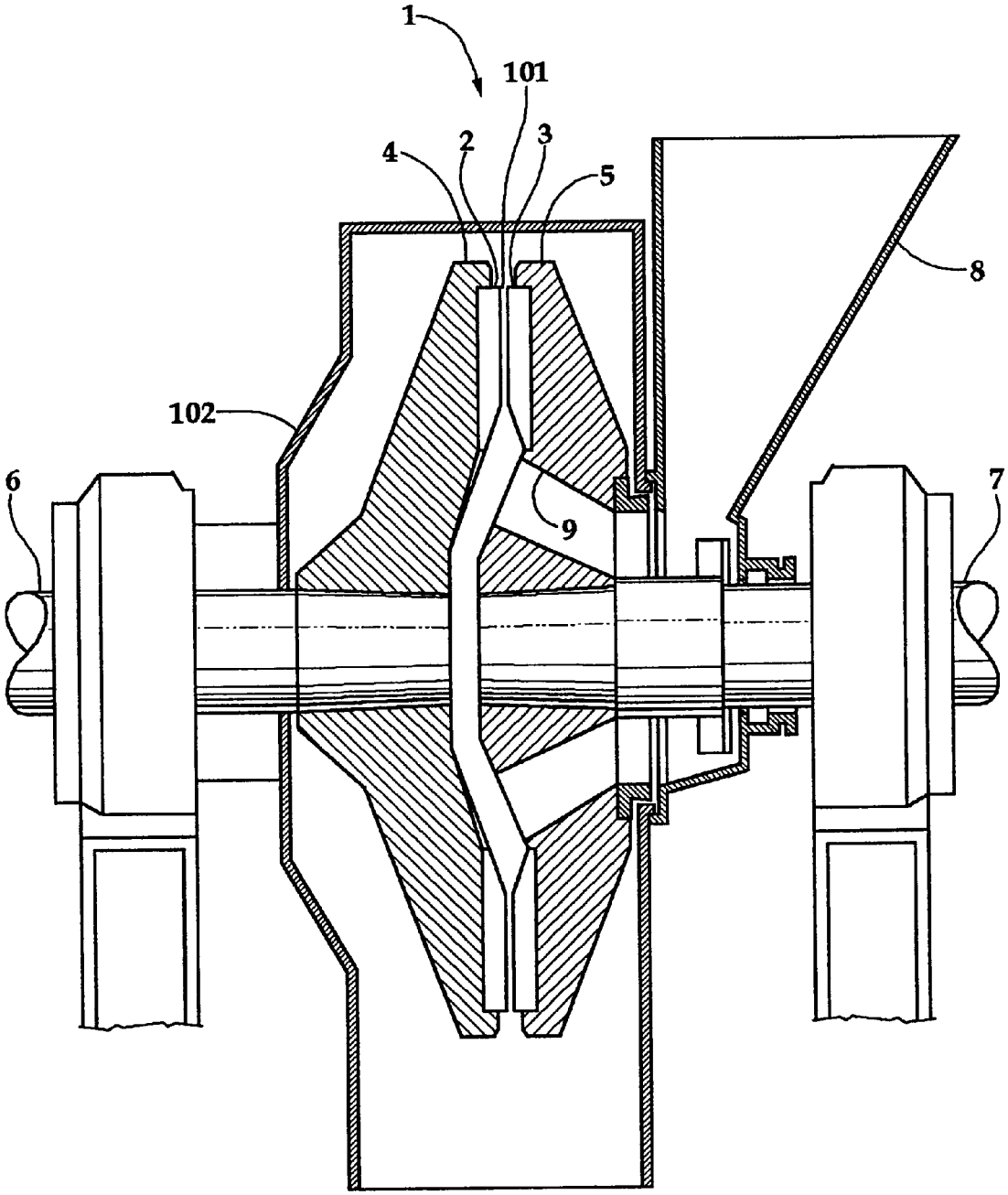
FIG. 3 is a side, partial sectional view of a counter-rotating disk refiner.
Figure 4:
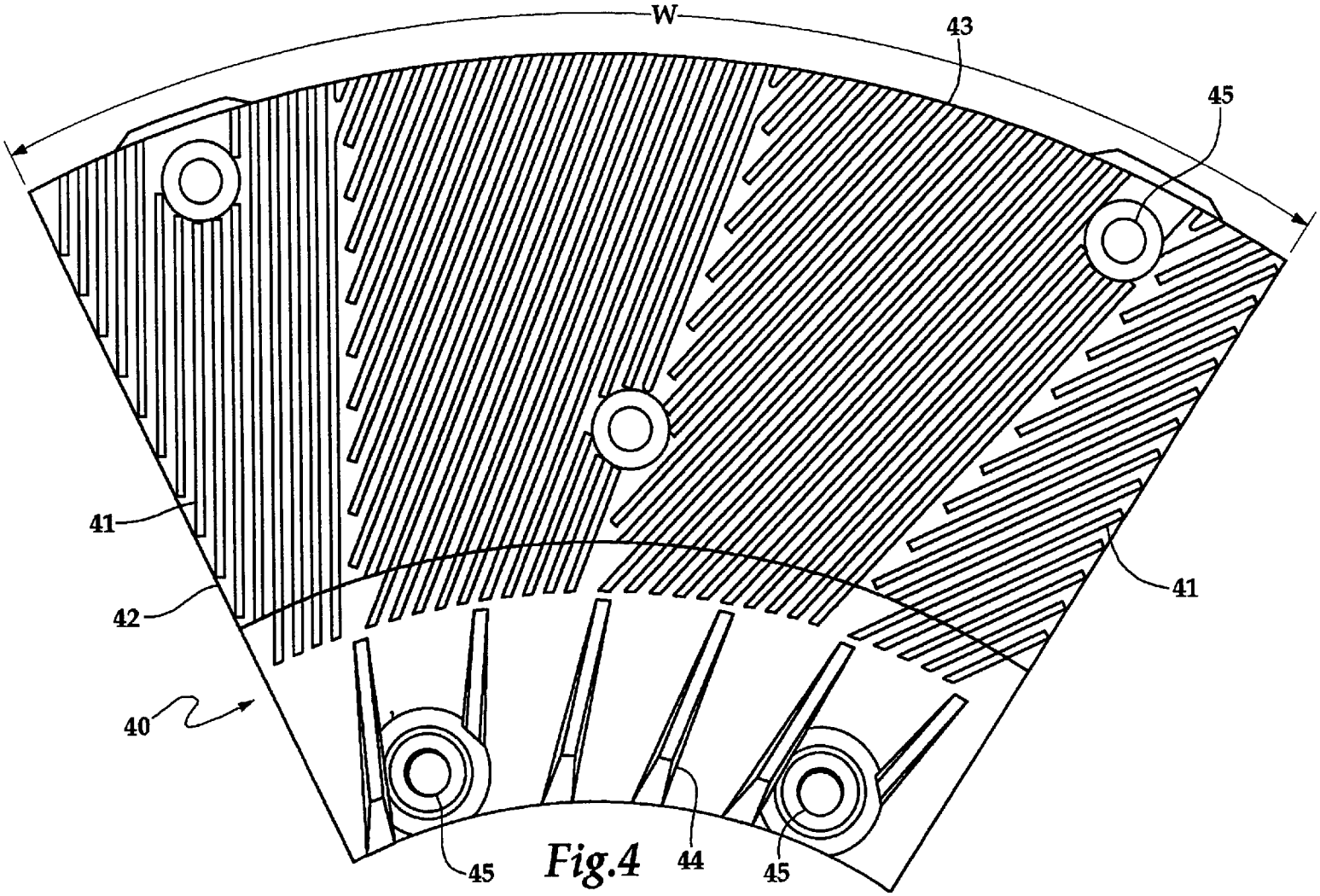
FIG. 4 is a plan view of a prior art refiner plate segment commonly used in double disk refiners and counter-rotating disk refiners.
Figure 5:
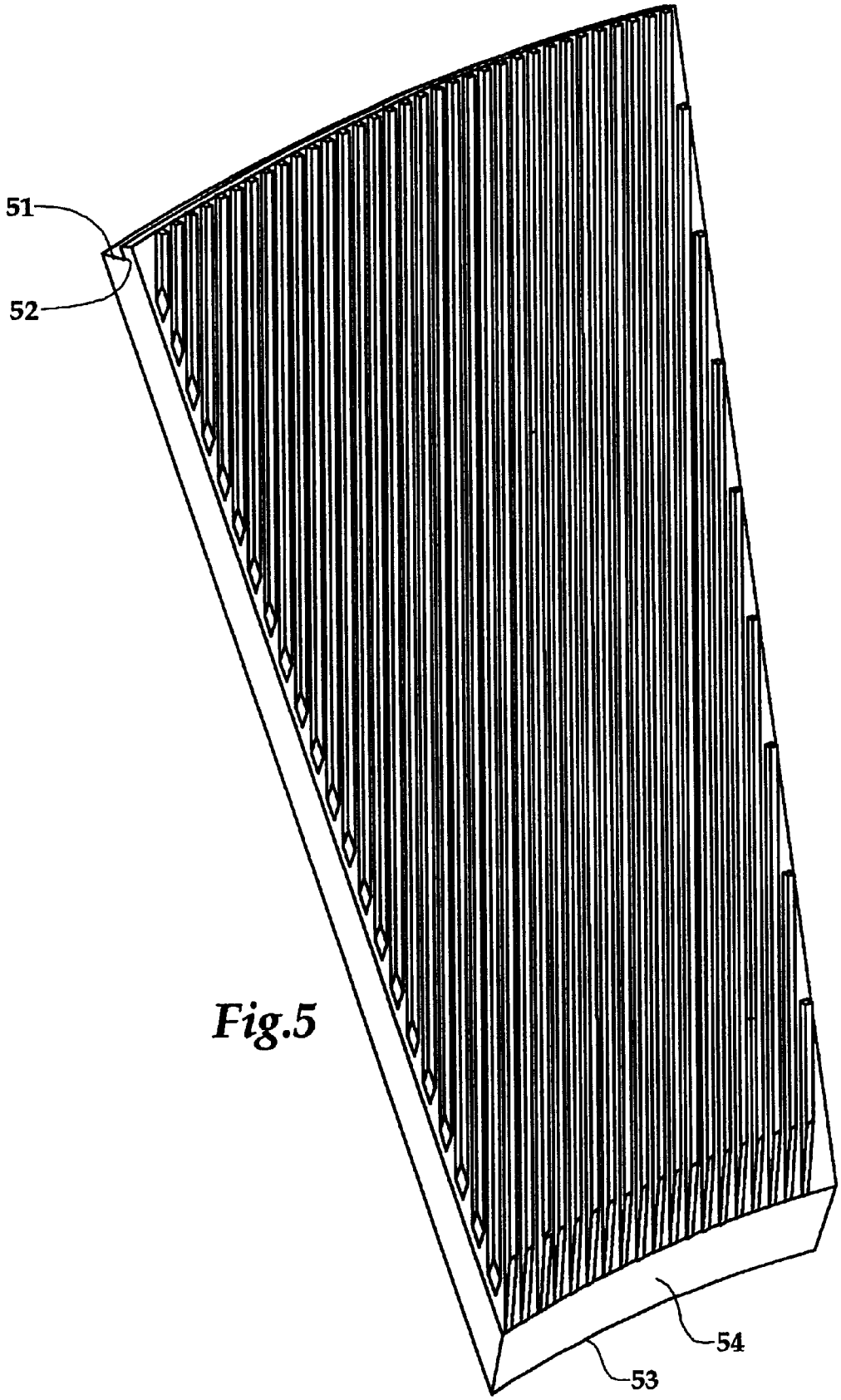
FIG. 5 is a plan view of a refiner plate segment of the present invention for a disk refiner.
Figure 6:
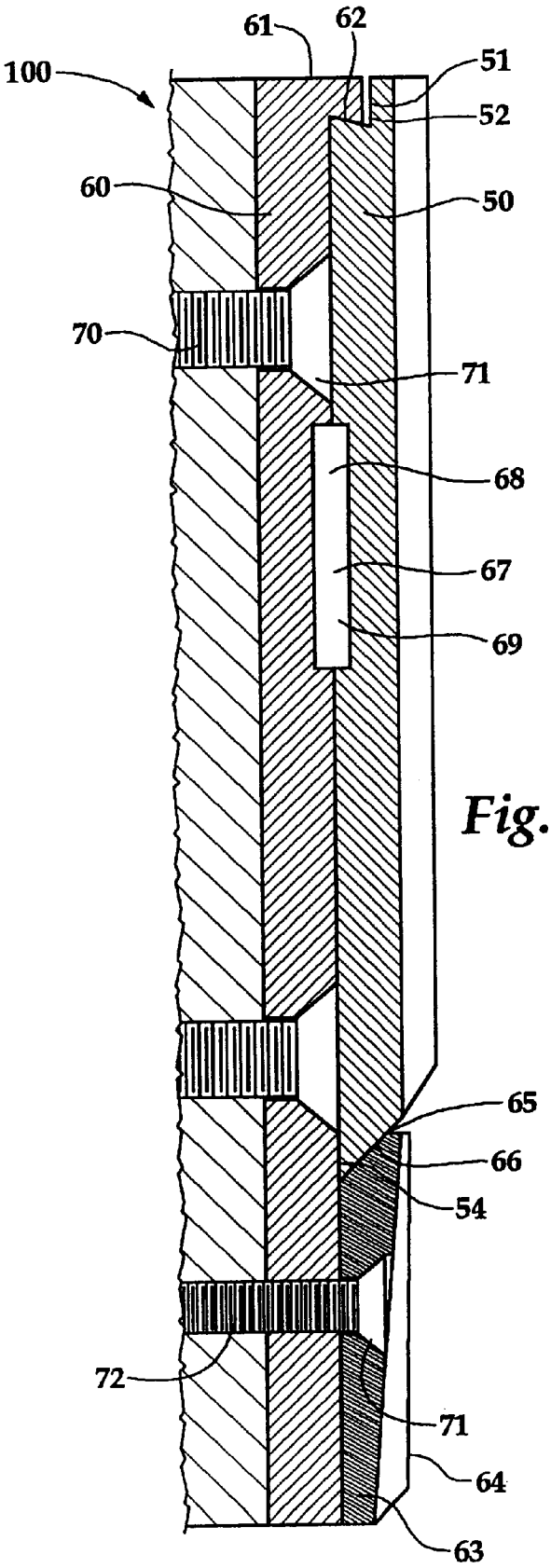
FIG. 6 is a cross-sectional view of a refiner plate assembly of the present invention.

Referring more particularly to FIGS. 1 through 8, wherein like numbers refer to similar parts, a universal refiner plate assembly (100) shown in FIG. 6 embodying the present invention is equipped to be installed within various disk refiners such as a double disk refiner (10) as shown in FIG. 1 or a multiple disk refiner (20) as shown in FIG. 2 or a counter-rotating disk refiner (1) as shown in FIG. 3.

The disk refiner (10) shown in FIG. 1 has a stock inlet (11) and outlet (12) through which papermaking stock and water, i.e. slurry, is pumped. The refiner has a moving rotor (13). Refiner plates (14) are mounted on the rotor (13) which is mounted to a shaft (19). Refiner plates (15) are mounted to stators (16) and (17) and are opposed to and closely spaced from the refiner plates (14) on the rotor (13). The rotor (13) has a passageway (18) which allows a portion of the paper slurry to flow through the rotor (13) and pass between the refiner plates (14) and (15) which are disposed between the rotor (13) and the stator (16). A portion of the slurry also passes between the refiner plates (14) and (15) which are disposed between the rotor (13) and the other stator (17).

A multiple disk refiner (20) is shown in FIG. 2. This refiner generally comprises a first housing part or stator (21) and a second housing part or stator (22) defining a refining chamber (23) therebetween. The refiner (20) further comprises a slurry flow path including a slurry input (24) to the refining chamber (23) and a slurry output (25) from the refining chamber (23). The refiner (20) further includes a rotatable shaft (26) for mounting a plurality of rotatable refiner plates (27). Alternately mounted with the rotatable refiner plates (27) are a plurality of nonrotatable refiner plates (28). The refiner (20) also has a first end refiner plate (29) and a second end refiner plate (30) respectively mounted to the housing parts or stators (21) and (22).

A counter-rotating disk refiner (1) is shown in FIG. 3. A first refiner plate (2) and a second refiner plate (3) are respectively mounted to two counter-rotating members (4) and (5). The two counter-rotating members (4) and (5) are located on a shaft (6) and (7) which are driven individually by motors (not shown). The refiner has a feed funnel (8) for guiding slurry or in some situations wood chips to an opening (9) which transports the slurry to a refining zone (101) located between plates (2) and (3). A housing (102) is provided to collect the refined slurry after the refined slurry flows out from the zone (101) between the refining plates (2) and (3).

A conventional prior art refiner plate segment (40) is shown in FIG. 4. This type of prior art refiner plate segment is suitable for use in double disk refiners shown in FIG. 1 and counter-rotating disk refiners shown in FIG. 3. The prior art refiner plate segment (40) has arrays of protruding refiner bars grouped in sets of straight parallel bars (41) and grooves (42) arranged in repeating fields (43). Various arrays of protruding refiner bars are known in the art. A plurality of refiner plate segments (40) cooperatively form a complete annular ring when fitted together.

Vanes (44) are positioned radially inwardly of the refiner bars (41) and help to accelerate and propel the slurry outward and into the refiner bars (41) during the refining operation. Adjacent to the vanes (44) and bars (41) are attachment holes (45), whereby the refiner plate segments (40) can be bolted or screwed to the rotor (13) or stators (16) and (17) of a disk refiner (10) shown in FIG. 1 or to the counter-rotating members (4) and (5) of a counter-rotating disk refiner (1) shown in FIG. 3. When the refiner bars (41) become worn or damaged, the refiner plate segment (40) is replaced.

Multiple disk refiners (20) as shown in FIG. 2, do not currently use refiner plate segments like those shown in FIG. 4. The refiner plate for multiple disk refiners consist generally of a singular construction. However, the arrays of protruding refiner bars of multiple disk refiner plates may be similar to the arrays of protruding refiner bars of double disk refiners or counter-rotating refiners. Although the end plates (29) and (30) of the multiple disk refiner (20) mount to the respective outer stators (21) and (22) in the same manner as the refiner plate segments (40) mount to the rotor (13) or stators (16) and (17) of the double disk refiner (10) or to the counter-rotating members (4) and (5) of the counter-rotating disk refiner (1), the refiner plates (27) and (28) of the multiple disk refiner (20) are mounted differently within the refiner (20). The rotatable refiner plates (27) are slidably mounted to the shaft (26), and the nonrotatable refiner plates (28) are slidably mounted to pins (31). When refiner bars of the refiner plate (27) or (28) or of the end plates (29) or (30)

become worn or damaged, the entire refiner plate (27) or (28) or end refiner plate (29) or (30) must be replaced.

The number and location of the holes (45) shown in FIG. 4, the size of the holes (45) and the spacing between the holes (45), are typically unique to individual disk refiner manufacturers. Thus, a refiner plate for a refiner made by one manufacturer may not attach to rotors or stators as shown in FIGS. 1, 2, and 3 of another manufacturer's disk refiner. Therefore, a refiner plate manufacturer must custom make each refiner plate for different refiners of a given diameter. In other words, a refiner plate for one disk refiner, is not interchangeable with a plate for another disk refiner, even though the disk refiners are of the same diameter. Manufacturing and storing many different refiner plates for the same diameter disk refiner is extremely cumbersome and costly to refiner plate manufacturers. Moreover, paper mills frequently utilize many different refiners, and because a refiner plate for a refiner made by one manufacturer may not attach to rotors or stators as shown in FIGS. 1, 2, and 3 of another manufacturer's disk refiner, paper mills have to store multiple refiner plates as a result of the many different mounting patterns.

An important aspect of the present invention is to be able to provide a refiner plate that is interchangeable with all refiners of the same diameter.

FIG. 5 shows a refiner plate segment (50) of the present invention. The outside diameter or first end surface (51) of the plate segment (50) has a dovetail (52). The inside diameter or second end surface (53) of the plate (50) has a taper (54). The bar and groove pattern shown is for illustrative purposes. It should be understood that any conventional pattern can be used on the segment (50). Further, as will be described hereinafter, the present invention makes possible the casting of finer patterns than previously done heretofore.

FIG. 6 shows a cross-sectional view of a refiner plate assembly (100) used in a disk refiner according to the present invention. The refining plate segment (50) is mounted to a subplate (60) which in turn is mounted to a rotor or stator as needed according to the devices shown in FIGS. 1, 2 and 3. Subplate (60) can be a single annular piece or made up of a plurality of individual subplates (60) that when fitted together form a complete annular ring. The outside diameter or first end surface (61) of the subplate (60) has a dovetail (62). Dovetail (52) of refiner plate segment (50) engages with dovetail (62) of subplate (60). Shown in FIG. 6 is a locking inner refiner plate or ring (63). Ring (63) can be a complete annular ring or made up of a plurality of inner refiner ring segments. Refiner vanes (64) of the locking inner refiner ring (63) are similar to the vanes (44) described for the refiner plate segment shown in FIG. 4. The outside diameter or first end surface (65) of the locking inner ring (63) has a taper (66). The angle of the taper (66) is supplementary to the angle of the taper (54) of segment (50). Taper (54) of refiner plate segment (50) engages with taper (66) of the locking inner ring (63). The refiner plate segment (50) is secured against radially outward movement on the subplate (60) via the dovetail (52) of the refiner plate segment (50) fitting into the mating dovetail (62) of the subplate (60). Also, the refiner plate segment (50) is further held onto the subplate (60) via the tapered fit between the tapers (54) and (66) of the refiner plate segment (50) and subplate (60) respectively. The tapered fit forces the refiner segment outward and downwardly during the refining operation. It should be noted that replacing the customized refiner plate segments of prior art double disk, multiple disk, and counter-rotating disk refiners with universal refiner plate segments (50) of the present invention, will not reduce the overall refining area. The refiner plate segments (50) are overhung at the outside diameter (51) to maintain the same diameter as the refiner plate being replaced.

As shown in FIG. 6, the refiner plate segment (50) has a key slot (67). Similarly, the subplate (60) also has a matching key slot (68). Torque is transmitted between the refiner plate segment (50) and the subplate (60) via a key (69) located at the center of the refiner plate segment (50) to help stabilize the refiner plate segment (50) during the refining operation.

The subplate (60) further comprises bolt or screw holes (70), whereby the subplate (60), can be bolted or screwed via flat head machine bolts or screws (71) to rotor (13) or stators (16), (17), (21), (22), or counter-rotating members (4) and (5) as needed for the disk refiners described in FIGS. 1, 2, and 3. The locking inner ring (63) contains holes (72) whereby the locking inner ring (63) can be bolted or screwed with flat head machine bolts or screws (71) to the subplate (60). The dovetail and taper attachment between refiner plate segment (50) and subplate (60), coupled with the key attachment underneath refiner plate segment (50) eliminates the need for any through attachment of segment (50) to subplate (60), resulting in an uninterrupted pattern on the segment (50) and easy removal of segments (50) from subplate (60). While the refiner plate assembly is described as utilizing a dovetail and taper attachment arrangements, those skilled in the art will recognize various other attachment configurations to accomplish the same features as the described dovetail and taper arrangements.

Figure 7:
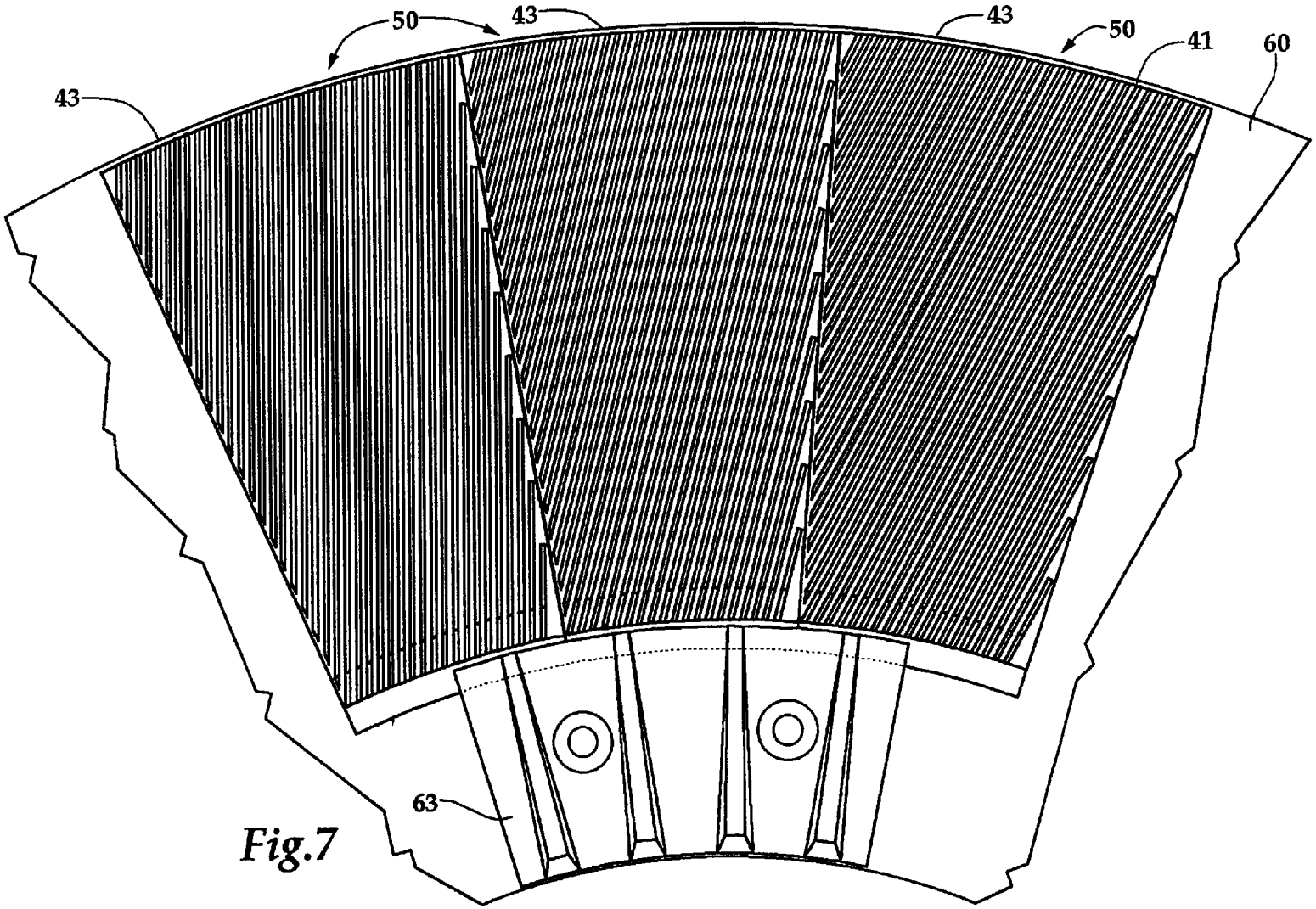
FIG. 7 is a plan view of several refiner plate segments of the present invention in assembled arrangement.
Figure 8:
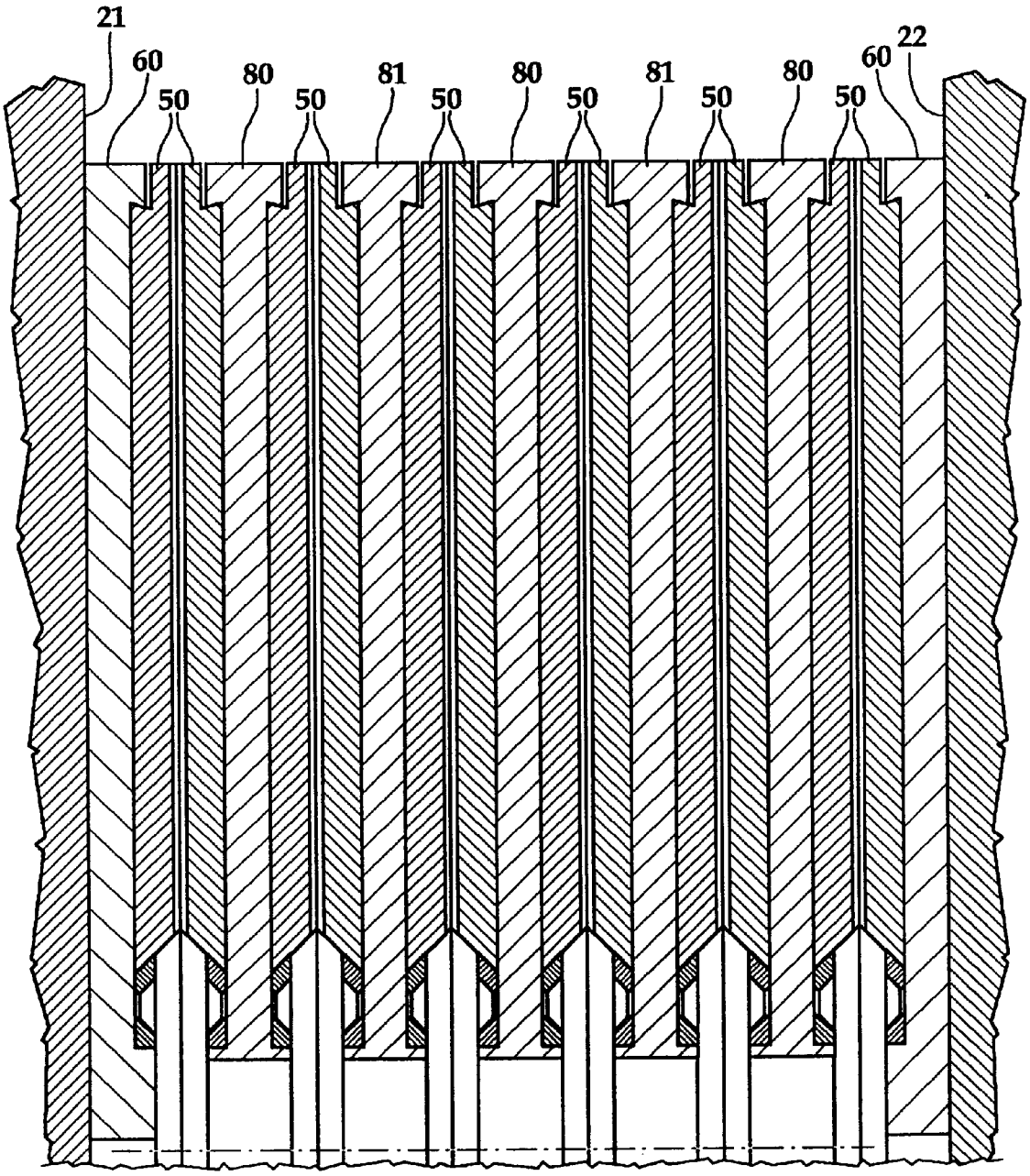
FIG. 8 is a cross-sectional view of refiner plate segment assembly of the present invention as used in a multiple disk refiner.

FIGS. 7 and 8 depict the assembly of refiner plate segments (50) into a double disk refiner (10) as shown in FIG. 1 or a multiple disk refiner (20) as shown in FIG. 2 or a counter-rotating disk refiner (1) as shown in FIG. 3. The prior art refiner plate segment (40) shown in FIG. 4 is essentially replaced with three smaller refiner plate segments (50) and locking inner rings (63) according to the present invention. FIG. 7 shows the refiner plate segments (50) being attached to the subplate (60). The subplate (60) is then or already attached to rotor (13) or stators (16) or (17) of the double disk refiner (10) or to the outer stator (21) or (22) of the multiple disk refiner (20) or to the counter-rotating members (4) and (5) of the counter-rotating disk refiner (1). The refiner plate segments (50) cooperatively form a complete annular ring around subplate (60) when fitted together. Once all of the refiner plate segments (50) are assembled into a circle, locking inner refiner rings (63) are bolted down against the refiner plate segments (50) to help secure them into place. Inner ring (63) can be a single complete annular ring or made up of a plurality of rings when fitted together form a complete annular ring. There can be a greater or fewer number of inner rings (63) than segments (50) depending on the manufacturer's preference.

The keys (69) shown in FIG. 6 inserted in key ways (67) and (68) of the refiner plate segment (50) and subplate (60) fix the plate segments (50) against rotation. Approximately two to eight keys (69) are required per annular ring of refiner plate segments (50). Thus not every refiner plate segment (50) must be attached to subplate (60) via a key (69). As shown in FIG. 7, refiner plate segments (50) encompass only one field (43) of refiner bars (41) instead of the standard two to four fields (43) per plate segment as shown in the prior art segment plate (40) in FIG. 4.

When the refiner bars (41) become worn or damaged, the refiner plate segment (50) which contains such bars must be replaced. To replace a refiner plate segment (50), the locking inner ring (63) is first detached from subplate (60). The refiner plate segment (50) is then removed from the subplate (60) and a new refiner plate segment (50) is engaged via the dovetail lip with the subplate (60), after which, the locking inner ring (63) is reattached to the subplate (60). Because of the manner in which disk refiners operate, which is well-known in the art, for normal operating conditions, it is believed that the locking inner rings (63) as well as the subplate (60) will be used for significantly longer periods than segments (50).

FIG. 8 shows the refiner plate segment (50) assembled into a multiple disk refiner (20) of the type described in FIG. 2. Instead of end plates (29) and (30) being attached directly to outer stators (21) and (22), refiner plate segments (50) are attached to subplates (60) which are attached to outer stators (21) and (22) in the same manner as described for the universal refiner plate assembly shown in FIG. 6. Instead of using single one-piece refiner plates (27) and (28) for the multiple disk refiner (20) in FIG. 2, according to the invention, rotating subplates (80) and nonrotating subplates (81) are slidably mounted to shaft (26) and pins (31), and refiner plate segments (50) are in turn mounted to subplates (80) and (81). The dovetail fits, taper fits, and locking inner refiner ring are all similarly adapted to this embodiment as was described for the double disk and counter-rotating disk refiners.

Prior art refiner plates for multiple disk refiners were single one-piece annular rings. As a result, these plates had to be fabricated rather than cast. It is well-known in the art that one cannot cast a single annular plate and hold the necessary tolerances for the plate to function properly in a multiple disk refiner. Not only is it easier to replace refiner plate segments (50) of the present invention rather than a complete single annular plate when the refiner bars (41) of the segment (50) become worn or damaged, the refiner plate segments used in conjunction with the invention can be cast instead of fabricated, thereby saving expenses in the use of these refiner plates.

Due to the corrosive environment of a paper refiner, subplate (60) and refiner plate segment (50) are produced out of a strong, corrosion-resistant material, such as stainless steel. Subplate (60) is custom made to match the mounting pattern of each different disk refiner manufacturer for a given refiner diameter. Refiner plate segments (50) can now be universalized and mass produced and assembled in any disk refiner of a given diameter. This represents a universal retrofit of refiner plate segments (50) of the same refiner bar pattern for all the same diameter refiners, double disk, multiple disk, or counter-rotating disk refiners regardless of manufacturer. This, of course, will reduce refiner plate inventory at paper mills with several different types of disk refiners of the same diameter.

As earlier noted, because the refiner plate segments (50) now encompass only one field (43) instead of the standard two to four fields of the prior art plate segment (40), the new refiner plate segments are much smaller, lighter, and easier to handle. Prior art segments (40) cannot currently be made with one field (43) because the width (w) of the prior art segments (40) is too large. The width of prior art segment (40) is controlled by the number of bolt holes (45) used to attach the segment (40) to the refiner. If field (43) of segment (40) is only one field, the bars (41) in order to extend across the whole width of the segment (40), would be virtually parallel with the segment (40) rather than set at an angle as shown in FIG. 4. As generally understood in the art, a bar arrangement of this type is not an acceptable refiner bar pattern. However, according to the invention, the width of segment (50) is not controlled by the number of bolt holes (45) and, thus, smaller plates are manufactured.

Creating smaller plates enables refiner plate manufacturers to utilize a different casting process. Investment casting is not feasible to make the current large refiner plate segments because of the high cost in utilizing this process. Making smaller refiner plates will make it economically feasible to use investment casting. Investment casting small refiner plate segments is on par economically with casting large refiner plate segments using the current sand casting method. Drawbacks to the current utilized sand casting method involve the potential for the segments to warp, not completely filling the area reserved for the refiner bars, and the difficulty associated with getting the volume of metal to fill the cast evenly and at the same time. Creating smaller plate segments by the investment cast method will produce finer, smaller bars and grooves over the same area as compared to a prior art refiner plate segment. Investment casting is a much more precise method of casting metal pieces than the sand casting method. As a result, the refiner plate segments of the invention have more uniform refiner bar widths, groove widths, and groove depths.

Making finer bars and grooves will increase the refining surface and, as a result, lower intensity treatment of pulp is attained which increases the strength characteristics of the pulp.

While a universal refiner plate segment and a method of mounting such segment to a double disk, multiple disk, or counter-rotating disk refiner has been shown and described in detail herein, various changes or modifications may be made without departing from the scope of the present invention.

I claim:

1. A modular refiner plate assembly for use in a disk refiner having a refiner plate mounting surface, said refiner plate assembly comprising:

a refiner plate having a refining surface, a first end surface and a second end surface;

a subplate disposed axially between said refiner plate mounting surface of said disk refiner and said refiner plate, said subplate having a first end surface for mating with said first end surface of said refiner plate such that said refiner plate engages said subplate;

a locking inner refiner ring having a first end surface for mating with said second end surface of said refiner plate, said locking inner refiner ring being removably attached to said subplate;

said subplate being removably attached to said mounting surface by a plurality of spaced apart fasteners that each extend into said subplate and into said mounting surface and which are each disposed axially rearward of said refining surface of said refiner plate;

said refiner plate being removably attached to said subplate; and wherein said refining surface of said refiner plate overlies at least one of said fasteners.

2. A modular refiner plate assembly as defined in claim 1, wherein said refining surface of said refiner plate is uninterrupted by any mounting hole.

3. A modular refiner plate assembly as defined in claim 2, wherein the first end surface of said refiner plate includes a dovetail and wherein the first end surface of said subplate includes a dovetail so that said refiner plate removably locks in place with said subplate.

4. A modular refiner plate assembly as defined in claim 3, wherein the second end surface of said refiner plate includes a taper and the first end surface of said inner refiner ring includes a taper so that the taper of said refiner plate and the taper of said locking inner refiner ring mesh together.

5. A modular refiner plate assembly as defined in claim 1, wherein said refiner plate is comprised of at least a plurality of refiner plate segments that form an annular ring, and further including at least a plurality of spaced apart locking inner refiner ring fasteners that attach said locking inner refiner ring to at least one of said refiner plate mounting surface and said subplate, wherein said locking refiner ring removably attaches said refiner plate segments to said subplate, and wherein said plurality of pairs of said spaced apart mounting holes in said subplate are arranged to enable said subplate to be mounted to disk refiners made by a plurality of manufacturers that each have a different refiner plate mounting bolt pattern.

6. A refiner plate assembly as defined in claim 1 wherein said refiner plate has a key slot and said subplate has a key slot and further comprising a key received in said key slot in said refiner slot and in said key slot in said subplate.

7. A refiner plate assembly as defined in claim 1 wherein said first end surface of said refiner plate comprises an outer radial edge of said refiner plate and wherein said locking inner refiner ring is disposed radially inward of said second end surface.

8. A refiner plate assembly as defined in claim 1 wherein said refiner plate comprises a plurality of refiner plate segments, each having a refining surface, wherein said refining surface of each of said refiner plate segments has a plurality of pairs of upraised radial bars extending generally in the same direction thereby defining a field of said bars and wherein each of said plurality of refiner plate segments has only one of said fields.

9. A modular refiner plate assembly for use in a disk refiner, the disk refiner being equipped with a rotary shaft supporting at least one rotor having oppositely facing refiner plate mounting surfaces and at least two stators having refiner plate mounting surfaces facing the rotor refiner plate mounting surfaces, said refiner plate assembly comprising:

refiner plate having a first end surface, a second end surface, and a refining surface comprised of a plurality of pairs of upraised refiner bars;

a subplate having a first end surface for mating with said first end surface of said refiner plate such that said refiner plate engages with said subplate;

a locking refiner ring having a first end surface for mating with said second end surface of said refiner plate, said locking refiner ring 1) being in operable communication with said subplate and 2) removably attaching said refiner plate to said subplate;

said subplate being removably attached to one of said mounting surfaces by a plurality of pairs of spaced apart fasteners, at least a pair of said fasteners being radially spaced apart and at least a pair of said fasteners being circumferentially spaced apart, with at least a plurality of said fasteners disposed radially of said locking refiner ring and extending axially outwardly no farther than said refining surface of said refiner plate; and wherein said subplate is disposed between said one of said refiner plate mounting surfaces and said refiner plate.

10. A modular refiner plate assembly as defined in claim 9, wherein said refining surface of said refiner plate is uninterrupted by any mounting hole, said subplate is connected to said mounting surface of one of said rotors within the disk refiner by said plurality of said fasteners, and a plurality of said fasteners axially underlies said refining surface of said refiner plate.

11. A modular refiner plate assembly as defined in claim 10, wherein the first end surface of said refiner plate includes a dovetail and wherein the first end surface of said subplate includes a dovetail so that said refiner plate removably locks in place with said subplate.

12. A modular refiner plate assembly as defined in claim 11, wherein the second end surface of said refiner plate includes a taper and the first end surface of said inner refiner ring includes a taper so that the taper of said refiner plate and the taper of said locking inner refiner ring mesh together.

13. A modular refiner plate assembly as defined in claim 12, including at least a plurality of refiner plate segments that when assembled together form a generally annular ring and wherein at least one of said refiner plate segments comprises a cast refiner plate segment.

14. A refiner plate assembly for use in a disk refiner, the disk refiner being equipped with counter rotating shafts supporting at least two counter-rotating members having oppositely facing refiner plate mounting surfaces, said refiner plate assembly comprising;

a refiner plate having a refining surface, a first end surface, and a second end surface;

a subplate having a first end surface for mating with said first end surface of said refiner plate such that said refiner plate attaches to said subplate;

a locking inner refiner ring having a first end surface for mating with said second end surface of said refiner plate, said locking inner refiner ring further being removably attached to said subplate;

said subplate being annular, removably attached to one of said refiner plate mounting surfaces within the disk refiner by a plurality of pairs of spaced apart subplate fasteners, and disposed between said one of said mounting surfaces and said refiner plate; and said refiner plate overlying at least a plurality of said subplate fasteners.

15. A refiner plate assembly as defined in claim 14, wherein the first end surface of said refiner plate includes a dovetail and wherein the first end surface of said subplate includes a dovetail so that said refiner plate removably locks in place with said subplate.

16. A refiner plate assembly as defined in claim 15, wherein the second end surface of said refiner plate includes a taper and the first end surface of said inner refiner ring includes a taper so that the taper of said refiner plate and the taper of said locking inner refiner ring mesh together.

17. A refiner plate assembly as defined in claim 16, including at least a plurality of refiner plate segments when assembled together form a complete annular ring and further including at least a plurality of locking inner refiner ring segments when assembled together form a second complete annular ring such that when said refiner plate segments and said locking inner refiner ring segments are attached to said subplate, said refiner plate assembly attaches to the mounting surface within the disk refiner.

18. A refiner plate assembly for use in a disk refiner, the disk refiner being equipped with a plurality of rotating subplates and a plurality of nonrotating subplates each having oppositely facing refiner plate mounting surfaces that are alternately mounted in a refining chamber, the rotating subplates being mounted on a rotatable shaft such that the rotating subplates rotate during operation and the nonrotating subplates being mounted so as to permit relative rotation between at least one of the rotating subplates, the refining chamber being located between a first stator and a second stator both having a mounting surface thereon, said refiner plate assembly comprising:

a plurality of refiner plates having refining surfaces, first end surfaces and second end surfaces;

said subplates each having first end surfaces for mating with said first end surfaces of said refiner plates such that said refiner plates are removably carried by said subplates;

a plurality of locking inner refiner rings having first end surfaces for mating with the second end surfaces of said refiner plates, said locking inner refiner rings further being removably attached to said subplates;

at least two of said subplates with 1) one of said subplates being removably attached to the mounting surface of said first stator of the disk refiner by a first fastener and disposed between said mounting surface of said first stator and one of said refiner plates, and 2) another of said subplates being removably attached to said mounting surface of said second stator of the disk refiner by a second fastener and disposed between said mounting surface of said second stator and another of said refiner plates; and wherein said first fastener attaching said one of said subplates to said mounting surface of said first stator underlies said refining surface of said one of said refiner plates and said second fastener attaching said another of said subplates to the mounting surface of the second stator underlies said refining surface of said another of said refiner plates.

19. A refiner plate assembly as defined in claim 18, wherein said one of said refiner plates overlies said first fastener and said another of said refiner plates overlies said second fastener.

20. A refiner plate assembly as defined in claim 19, wherein the first end surfaces of said refiner plates include dovetails and wherein the first end surfaces of said subplates include dovetails so that said refiner plates removably lock in place with said subplates.

21. A refiner plate assembly as defined in claim 20, wherein the second end surfaces of said refiner plates include tapers and the first end surfaces of said locking inner refiner rings include tapers so that the tapers of said refiner plates and the tapers of said locking inner refiner rings mesh together.

22. A refiner plate assembly as defined in claim 21, including at least a plurality of refiner plate segments when assembled together form a complete annular ring, at least a plurality of locking inner refiner ring segments when assembled together form a second complete annular ring, and said refiner plate segments and said locking inner refiner ring segments being attached to said subplates.

23. A refiner plate assembly for a disk refiner having a refiner plate mounting surface comprising a plurality of refiner plate segments, each having a refining surface, removably carried by an adapter subplate removably attached by a plurality of pairs of fasteners to said refiner plate mounting surface of said disk refiner wherein said adapter subplate is disposed between said refiner plate mounting surface and said plurality of refiner plate segments such that each of said refiner plate segments substantially overlap said adapter subplate and wherein a pair of said plurality of pairs of fasteners is radially spaced apart, a pair of said plurality of pairs of fasteners is circumferentially spaced apart, and at least one of said fasteners is disposed axially rearward of said refining surface of one of said refiner plate segments.

24. A refiner plate assembly as defined by claim 23 further comprising a locking portion disposed radially inwardly of each of said plurality of refiner plate segments and which captures each of said plurality of refiner plate segments between said locking portion and a ridge upstanding from said adapter subplate.

25. A refiner plate assembly as defined by claim 24 wherein said locking portion comprises an annular ring removably attached to said adapter subplate.

26. A refiner plate assembly as defined by claim 25 wherein adapter subplate is disposed between said mounting surface and said locking portion.

27. A refiner plate assembly as defined by claim 26 wherein 1) said adapter subplate has an axial surface with a generally radially extending keyway therein, 2) at least one of said plurality of refiner plate segments has an axial surface with a keyway therein, and 3) said axial surface of said adapter subplate faces said axial surface of said at least one of said plurality of refiner plate segments, and further comprising a key disposed in said keyway in said adapter plate and in said keyway in said at least one of said plurality of refiner plate segments.

28. A refiner plate assembly as defined by claim 27 wherein said locking ring is removably mounted to said adapter plate by a plurality of fasteners.

29. A refiner plate assembly as defined by claim 28 wherein each said fastener comprises a bolt or a screw.

30. A refiner plate assembly comprising:

a) a substantially flat refiner disk mounting surface on a rotor or stator of a disk refiner;

b) a refiner disk segment having 1) an axial refining surface with a plurality of pairs of spaced apart and generally radially extending refining bars, 2) an inner axial surface, 3) a plurality of radial edges with i) one of said radial edges having a dovetailed portion and ii) another of said radial edges having an inclined portion;

c) an adapter plate that is removably mounted to said refiner disk mounting surface of one of said rotor or said stator of a plurality disk refiners each having a different refiner disk mounting arrangement wherein said adapter plate 1) releasably mounts thereto said refiner disk segment, 2) has an inner axial surface disposed toward said mounting surface, 3) has an outer axial surface toward which said inner axial surface of said refiner disk segment faces such that said adapter plate is disposed between said mounting surface and said refiner disk segment, and 4) has a dovetailed portion carried by said outer axial surface of said adapter plate for operably cooperating with said dovetailed portion of said disk refiner segment to help releasably retain said refiner disk segment;

d) a locking plate that is removably mounted to said adapter plate and which operably cooperates with said inclined portion to help releasably retain said refiner disk segment;

e) a plurality of adapter plate fasteners removably mounting said adapter plate to said refiner disk mounting surface;

f) a plurality of locking plate fasteners removably mounting said locking plate to one of said adapter plate and said mounting surface;

g) wherein at least one of said adapter plate fasteners is disposed axially behind said refining surface of said refiner disk segment such that said refining surface 1) overlies said at least one of said adapter plate fasteners and 2) is uninterrupted by any hole;

h) wherein said locking plate has a plurality of spaced apart, axially upraised, and generally radially extending vanes; and i) wherein said refiner disk segment is releasably retained by said locking plate without any bolt or screw engaging said refiner disk segment.

31. The refiner plate assembly as defined by claim 30 wherein a) said dovetailed portion of said refiner disk segment comprises a dovetail recess in said outer peripheral edge of said refiner disk segment and said dovetailed portion of said adapter plate comprises an upraised dovetail adjacent said outer peripheral edge of said adapter plate wherein said dovetail is received in said dovetail recess when said refiner disk segment is removably mounted to said adapter plate;

b) said inclined portion comprises said inner radial edge of said refiner disk segment and said locking plate comprises a ring disposed adjacent said inner radial edge of said refiner disk segment having a complementary inclined surface that bears against said inclined inner radial edge of said refiner disk segment to retain said refiner disk segment against said adapter plate when said locking plate is mounted to said adapter plate.

32. The refiner plate assembly as defined by claim 31 further comprising a generally radially extending key having a portion received in a first key slot in said outer axial surface of said adapter plate and having another portion received in a second key slot in said inner axial surface of said refiner disk segment that resists said refiner disk segment from moving relative to said adapter plate.

33. The refiner plate assembly as defined by claim 30 wherein a plurality of pairs of said refiner disk segments are releasably mounted to said adapter plate without any bolt or screw extending through any of said refiner disk segments.

34. The refiner plate assembly as defined by claim 33 wherein said refiner comprises a multiple disk refiner and said refiner disk segment comprises an investment cast refiner disk segment.

35. The refiner plate assembly as defined by claim 33 wherein each of said adapter plate fasteners comprises a bolt or a screw.

* * * * *

UNITED STATES PATENT AND TRADEMARK OFFICE

CERTIFICATE OF CORRECTION

PATENT NO. : 5,934,585
DATED : August 10, 1999
INVENTOR(S) : Michael B. Chaney

It is certified that error appears in the above-identified patent and that said Letters Patent is hereby corrected as shown below:

On the title page add item -- [73] Assignee: J & L Fiber Services, Inc., --
Waukesha, Wisconsin Signed and Sealed this Twenty-eighth Day of March, 2000

*Attest:*

Q. TODD DICKINSON

*Attesting Officer*

*Commissioner of Patents and Trademarks*